US006068871A

United States Patent [19]

Fond et al.

[11] Patent Number: 6,068,871

[45] **Date of Patent: *May 30, 2000**

[54] BEVERAGE PREPARATION FROM A SUBSTANCE COMPACTED INTO A CAKE AND CONTAINED IN A SACHET

[75] Inventors: Olivier Fond, Dieppe, France; Jean-Pierre Pleisch, Chardonne, Switzerland; Roland Rossier, La Tour-de-Peilz, Switzerland; Jacques Schaeffer, Chardonne, Switzerland; Alfred Yoakim, La Tour-de-Peilz, Switzerland

[73] Assignee: Nestec S.A., Vevey, Switzerland

[ * ] Notice: This patent is subject to a terminal disclaimer.

[21] Appl. No.: 09/178,727

[22] Filed: Oct. 26, 1998

Related U.S. Application Data

[60] Continuation-in-part of application No. 08/492,732, Jun. 20, 1995, which is a division of application No. 08/178,326, Jan. 11, 1994, and a continuation of application No. PCT/CH93/00171, Jul. 2, 1993.

[30] Foreign Application Priority Data

Jul. 6, 1992 [EP] European Pat. Off. ..... 92111422

[51] Int. Cl.[7] ..... A23F 5/26

[52] U.S. Cl. ..... 426/433; 426/435; 426/77; 426/595; 426/144; 426/112

[58] Field of Search ..... 426/433, 435, 426/77, 595, 144, 112; 99/295

[56] References Cited

U.S. PATENT DOCUMENTS

| | | | |
|---|---|---|---|
| 1,210,542 | 1/1917 | Savageau . | |
| 1,951,357 | 3/1934 | Hall . | |
| 2,186,087 | 1/1940 | Yates . | |
| 2,235,315 | 3/1941 | Donnelly . | |
| 2,715,868 | 8/1955 | Brown | 426/433 |

(List continued on next page.)

FOREIGN PATENT DOCUMENTS

| | | |
|---|---|---|
| 808558 | 3/1969 | Canada . |
| 0006175 | 1/1980 | European Pat. Off. . |
| 229920 | 7/1987 | European Pat. Off. . |
| 272432 | 6/1988 | European Pat. Off. . |
| 2211924 | 7/1974 | France . |

(List continued on next page.)

OTHER PUBLICATIONS

Bakker, et al., (Editors) *The Wiley Encyclopedia Of Packaging Technology*, John Wiley & Sons, New York, N.Y., U.S.A., 1986, pp. 317–325, 346–351, 451–464.

Wiley Encyclopedia of Packaging Technology J. Wiley & Sons, 1986.

*Primary Examiner*—Steven L. Weinstein
*Attorney, Agent, or Firm*—Vogt & O'Donnell, LLP

[57] ABSTRACT

A powdered substance, which is suitable for preparation of a beverage with an extraction fluid, is extracted for preparation of a beverage. The substance which is compacted in a form of a cake, is contained within a sachet between two sachet sheets which, prior to extraction of the substance, protect the substance against oxygen and water vapor and which extend to sealed edges for containing the substance within the sheets prior to and during extraction. In effecting extraction, one sheet is perforated to provide at least one opening for injection of extraction fluid, and extraction fluid is injected under pressure into the sachet for contacting and deforming the compacted substance cake and for extracting the substance in the sachet, and the other sheet is deformed against a surface having portions forming, upon deformation of the second sheet, local breakages in that sheet for opening that sheet for flow of extracted beverage substance. The cake and sheets advantageously are configured so that there is free space between at least one of the cake surfaces and one sheet for allowing the substance to expand between the sheets, and a cake surface may have a concave shape or may have channel impressions therein and be positioned adjacent the at least one opening for injection of extraction fluid.

10 Claims, 3 Drawing Sheets

U.S. PATENT DOCUMENTS

| | | | |
|---|---|---|---|
| 2,778,739 | 1/1957 | Rodth . | |
| 2,824,002 | 2/1958 | Hiscock . | |
| 3,209,676 | 10/1965 | Zimmermann et al. | 99/289 |
| 3,293,042 | 12/1966 | Eitzen | 426/77 |
| 3,295,998 | 1/1967 | Goros | 99/282 |
| 3,327,613 | 6/1967 | Davis | 99/282 |
| 3,370,523 | 2/1968 | Wright | 99/282 |
| 3,403,617 | 10/1968 | Lampe | 99/295 |
| 3,445,237 | 5/1969 | Gidge . | |
| 3,470,812 | 10/1969 | Levinson | 99/295 |
| 3,511,666 | 5/1970 | Hudson et al. . | |
| 3,607,297 | 9/1971 | Fasano . | |
| 3,770,457 | 11/1973 | Makwinski et al. | 426/394 |
| 3,812,273 | 5/1974 | Schmidt | 426/433 |
| 3,937,134 | 2/1976 | Molenaar et al. | 99/295 |
| 4,136,202 | 1/1979 | Favre | 426/77 |
| 4,254,694 | 3/1981 | Illy | 99/295 |
| 4,429,623 | 2/1984 | Illy | 99/295 |
| 4,806,375 | 2/1989 | Favre | 426/433 |
| 4,846,052 | 7/1989 | Favre et al. | 99/295 |
| 4,886,674 | 12/1989 | Seward et al. | 426/79 |
| 4,983,410 | 1/1991 | Dinos | 426/77 |
| 5,012,629 | 5/1991 | Rehman et al. | 53/453 |
| 5,242,702 | 9/1993 | Fond | 426/433 |
| 5,298,267 | 3/1994 | Gruenbacher | 426/77 |
| 5,327,815 | 7/1994 | Fond et al. | 99/295 |
| 5,343,799 | 9/1994 | Fond | 99/295 |
| 5,398,595 | 3/1995 | Fond et al. | 99/295 |
| 5,398,596 | 3/1995 | Fond | 99/295 |
| 5,402,707 | 4/1995 | Fond et al. | 99/295 |
| 5,472,719 | 12/1995 | Favre | 426/77 |
| 5,656,316 | 8/1997 | Fond et al. | 426/433 |
| 5,826,492 | 10/1998 | Fond et al. | 99/295 |

FOREIGN PATENT DOCUMENTS

| | | |
|---|---|---|
| 495138 | 10/1970 | Switzerland . |
| 636311 | 5/1983 | Switzerland . |
| 3480 | of 1811 | United Kingdom . |
| 4222 | of 1880 | United Kingdom . |
| 5034 | of 1882 | United Kingdom . |
| 510 | of 1899 | United Kingdom . |
| 939934 | 10/1963 | United Kingdom . |
| 2183459 | 6/1987 | United Kingdom . |
| 9207775 | 5/1992 | WIPO . |

BEVERAGE PREPARATION FROM A SUBSTANCE COMPACTED INTO A CAKE AND CONTAINED IN A SACHET

CROSS-REFERENCE TO RELATED APPLICATIONS

This is a continuation-in-part application of application Ser. No. 08/492,732, which was filed Jun. 20, 1995 and which, in turn, is a divisional application of application Ser. No. 08/178,326, which was filed Jan. 11, 1994 as a National Stage Application of PCT International Patent Application PCT/CH93/00171 which was filed Jul. 2, 1993.

BACKGROUND OF THE INVENTION

The invention relates to a sealed flexible sachet, containing at least one powder substance for the preparation of a beverage including substances compacted into a cake by extraction under pressure and to manufacture of the sachet.

The use of pre-metered and pre-packaged portions of ground coffee for the preparation of expresso-type coffee has the advantage that it facilitates the coffee preparation operations while ensuring that the quality of the product is relatively consistent.

These portions are currently provided in three main forms. According to a first version, pre-packaged portions disclosed in Swiss Pat. No. 636 311, and in U.S. Pat. No. 5,012,629 and in European Patent Application Publication No. 272 432 are formed by two sheets of filter paper sealed over their periphery and filled with ground coffee. This solution has the drawback that an oxygen-barrier outer packaging is required to prevent oxidation of the product during storage, entailing additional costs and a supplementary operation for the consumer who has to remove it before the desired coffee can be extracted.

According to a second version, disclosed in PCT Patent Application Publication No. WO 92/07775, the portion is formed by a sealed capsule opening into its extraction device under the action of the introduction of the extraction fluid, after deformation and then perforation by pointed members.

This capsule, formed by a sealed envelope forming a lateral wall and two walls, one of which forms the base of the cartridge and the other of which closes the opposite end of the cartridge, has the drawback that it makes use of different packaging materials, some of which have to be thick enough to make them semi-rigid, and can be used only in one direction, i.e., with the cap surface upwards in an extraction device which is completely adapted to the capsule and to its arrangement.

According to a third version, U.S. Pat. No. 3,607,297 discloses sachets for the preparation of a beverage in the form of a strip having filling cavities and a flat cap on the upper surface. According to this patent these sachets are adapted for gravity flow and have to be perforated on both surfaces by toothed plates, one of which is pushed by a spring.

SUMMARY OF THE INVENTION

The aim of the present invention is to provide a sealed flexible sachet containing ground roast coffee and adapted to be extracted under pressure for the preparation of a beverage, this sachet requiring no outer packaging and the extraction system being adapted solely to the sachet and not to the arrangement of the sachet, as it is fully adapted to be extracted in one or other direction.

The present invention also aims to limit to a minimum the quantity of material needed for the packaging of a portion.

The invention provides a flexible sachet in the form of an individual portion formed by thin, sheets of circular, oval or polygonal shape, which provide between one another a space for the powder substance and which are sealed over their periphery so that the sachet is substantially symmetrical with respect to its plane of sealing. The material used for the flexible sheets is impermeable to oxygen and water vapor.

The sheets used to form the sachet may be identical, but as a variant, for reasons relating to manufacture, the two flexible sheets may, however, differ slightly from one another as regards shape and/or material without thereby impairing the symmetry required for extraction.

The invention also includes embodiments wherein the powder substance is in a form of a compacted cake of powder substance wherein one or more pieces of the compacted caked substance is/are contained between the sheets.

The invention also relates to the method of manufacture of the sachet described above, in which two flexible sheets, which are impermeable to oxygen and water vapour, are deformed in a symmetrical manner by moulding or by stretching, a metered quantity of powder substance is placed on one of the deformed flexible sheets and the two sheets are sealed over their periphery.

DETAILED DESCRIPTION OF THE INVENTION

The method and the device used for the extraction of sachets of the invention may advantageously be of the type disclosed in European Patent Applications 92107548.7 or 92112364, the '364 Application being a counterpart of and the priority application for U.S. application Ser. No. 08/608,662 which was filed Feb. 29, 1996 and which was a continuation application of application Ser. No. 08/178,325, which was filed Jan. 11, 1994 as a National Stage Application of PCT International Patent Application PCT/CH93/00180 filed Jul. 12, 1993 and which is now U.S. Pat. No. 5,649,472, the disclosures of these applications and the patent, including but not limited to the specification text and drawings, being incorporated herein by reference and relied upon as if fully set forth herein. The upper surface of the sachet is firstly opened by one or a plurality of perforating members provided under surface of the device, and the lower surface is opened by local breakages following its deformation against raised and hollow portions which are not cutting or perforating disposed on the lower surface of the device, solely under the effect of the pressure increase during the injection of the extraction fluid. There is consequently no need to open the sachet in advance or to remove a portion of material therefrom prior to its use. After use, the sachet may be readily removed with a minimum of waste.

Therefore, since the sachet of the present invention is symmetrical, the user may insert it into the extraction system without paying attention to the direction of introduction. Moreover, the sachet is ready for immediate use and requires no prior preparation before insertion into the extraction system.

However, when the extraction device available is only partial with respect to the device described above, i.e., it does not comprise the means for opening one or other of the two surfaces, for instance, a device of the type of conventional espresso machines, openings may be provided, just prior to positioning in this partial extraction device, in one and/or the other surface of the sachet, allowing the passage of the extraction fluid.

The inner diameter of the sachet is preferably between 25 and 70 mm and the sealed edge has a width of 3 to 15 mm.

Once filled, the sachet preferably has a thickness of between 5 and 20 mm at its centre. The quantity of powder substance which it contains may vary between 5 and 20 g depending on its use.

The sachet is filled with a powder substance for the preparation of a beverage. This substance is preferably roast and ground coffee, but may also be tea, soluble coffee, a mixture of ground and soluble coffee, chocolate or any other dehydrated food substance.

The powder substance is compacted conventionally during the manufacturing process.

The external shape of the sachet is preferably circular, but may also be oval or polygonal with four to ten sides possibly with rounded edges, or may be a combination of these three elements. Its section is preferably substantially in the form of a flattened hexagon, but it may also have a lenticular shape. According to a variant, not illustrated, the sachet is provided with at least one lateral tongue facilitating its positioning. This tongue is simply produced when the sachet is cut out.

According to a first configuration and production variant, the sachet is formed by two sheets sealed over their periphery, the seal being provided as a plane surface.

According to the first production variant, the two sheets are stretched in advance (deformation in the plastic zone) in order to avoid any random folds due to the volume expansion of a material which is originally plane, either by means of compression in a die-piston assembly, or by means of pressurization by a gas of the inner surfaces and/or possibly suction of the outer surfaces in a mould of appropriate shape at a controlled temperature, in which the sheets are kept plane at their periphery.

According to a second production variant, the material is simply pushed back as in the two examples above, but in this case, it is not held at its periphery and then has more or less random folds resulting from the volume expansion of a plane surface.

According to a second configuration, the two sheets are pre-formed in a systematic and controlled manner and sealing is carried out, after filling with the powder substance, in accordance with a three-dimensional device. The volume expansion of a plane surface, without elastic or plastic stretching, means that the apparent diameter of the material is modified with respect to its real diameter. This excess material has to be compensated by an appropriate geometrical shape in order to avoid any random folds.

In order to achieve this aim, systematic and controlled molding takes place in a mold in which, at all locations, the principle of the equality of the apparent deployed diameter and the real diameter is ensured. This is obtained in the mold by creating corrugations of varying height which flare outwards. In the central portion sheets of the sachet, deformation is non-existent or small because this involves the reference plane. In contrast, as they develop towards the outer diameter, these corrugations increase in height and become flared. This corrugation depends on the ratio between the diameter of the sachet and the distance between the planes of the sealing zone and that in the central zone of the sachet, i.e., half the height of the sachet.

The two sheets of the sachet undergo equivalent volume expansion and are positioned during sealing, after filling, so that they are correctly superimposed on one another. The sealing zone of the two sheets thus takes the form of a corrugated circular strip.

This molding of the sheets is carried out, either by means of compression in a die-piston assembly, or by means of pressurization by a gas of the inner surfaces and/or suction of the outer surfaces. In both cases, the mold has the desired relief.

According to a third configuration, the sachet may have gussets on one or more sides. The gussets, resulting from folding prior to the sealing of the sheets, make it possible to provide the assembly with a specific volume, while eliminating random folds. The manufacture of sachets using this latter method may be carried out in a known manner.

The sheets may be made from a flexible material such as aluminum of a thickness of 5 to 40 $\mu$m or plastic such as polyethylene-terepthalate (PET) (polyester) or from polyethylene (PE), polypropylene (PP), oriented polypropylene (OPP), polyamide (PA), polystyrene (PS), ethylene and vinyl alcohol copolymer (EVOH), polyvinylidene chloride (PVDC) and polyvinyl alcohol (PVA), and may be single layer sheets or multilayer sheets including paper.

The sheets are preferably made from a flexible multilayer material suited to sealing by conventional methods, while protecting the product adequately against oxygen and water vapour. The following combinations of material are recommended:

outer layer: PET (normal, woven or nonwoven), PE, PP, PA, PS or paper;

high-barrier central layer: aluminum of a thickness of 5 to 20 $\mu$m, EVOH, PVDC, PET or PVA; and inner layer: plastic, preferably PE or PP or OPP.

The following multi-layer combinations can be envisaged: PET-EVOH-PE or PET-aluminum-PE. The use of biodegradable or hydrosoluble material is also possible as a single layer or in combination with other materials.

In a case wherein PET is used, it may take a form of a single layer combining the outer and central layers, particularly if it is filled with a layer of silicon oxide or if it is metalized.

According to a variant, the thermosealing operation is facilitated by the insertion between the two sheets of an intermediate material, such as a food glue or a coating of plastic material. This material can then form a further thickness advantageously used to provide complete leak-tightness during extraction.

The sachet of the invention preferably contains a compacted cake of the powder substance in the form of one or more pieces, the compacting rate being such that there is a reduction of volume of between 10% and 60% with respect to the non-compacted substance.

This compacting is carried out so that the free space between the two flexible sheets and the substance accounts for between 1 and 20% of the total space between the flexible sheets. This free space is needed to allow the coffee to expand sufficiently, during extraction, to allow correct extraction.

The compacted substance further comprises, on at least one of its surfaces, Impressions forming water circulation channels of appropriate shape (for instance crosses, circles) making it possible to improve the pre-moistening of the sachet and its extraction. The shape of the se impressions is selected in accordance with the extraction device used.

The compacted material may also have, on at least one of its surfaces, a concave or convex shape making it possible, where necessary, to modify the compacted state during its positioning in the extraction device.

This shape is adapted to the arrangement of the extraction chamber and may be advantageously used to ensure a correct leak-tightness of the sachet in the peripheral zone of injection, i.e., between the upper surface of the extraction chamber and the upper sheet of the sachet.

According to a first embodiment of a manufacturing process, the substance may be compacted after it has been metered out and placed between the sheets of the sachet.

According, to a second preferred embodiment, the substance is compacted and then metered out and placed between the sheets of the sachet. Depending on the shape and size of the pieces of compacted substance, one or several pieces are used to obtain the desired quantity.

Compacting at an appropriate pressure and into an appropriate shape may also be carried out after closure of the sachet.

Compacting is carried out in a conventional manner, either by rollers or by a die-piston assembly, the physico-chemical parameters such as pressure, temperature and moisture level of the substance being adapted to the nature of the substance to be compacted.

According to a particular embodiment, the compacted substance may be partially or completely decompacted after closure of the sachet, for instance by vibration or by any other known mechanical means.

New compacting at an appropriate pressure and into an appropriate shape may also be carried out after the closure of the sachet.

When the powder substance is subject to oxidation, the manufacturing operations can be carried out under the protection of a current of inert, oxygen-free gas, for instance under nitrogen or $CO_2$.

Some plastic materials have the property that they return substantially to their initial shape after temporary deformation. The sachet of the invention makes use of this property, together with an appropriate configuration of its extraction device. The lips of the openings formed by the perforated portions of the sachet consequently close about tapered perforating members such as needles, ensuring the desired leak-tightness about these members during extraction. After extraction, this property also limits discharges from the sachet during its removal, including those portions torn by the extraction system.

The symmetry of the sachet, in terms of both shape and material, its flexibility and the property mentioned above, make it possible at will to vary the method and the location of water introduction and extraction. Both may be, for instance, concentric, on the same surface or on opposite surfaces, the objective being to cause the water to travel an optimum path.

The flexibility of the walls of the sachet is also advantageously used to allow, by its deformation without breakage in the extraction device, a reconfiguration of the volume of the coffee which it contains. This controlled deformation is designed to improve the distribution of the flow in the bed of coffee and consequently the quality of extraction.

Moreover, taking account of the method of extraction for which it is designed, the sachet is formed by a combination of materials selected according to an additional criterion of plasticity. The deformability by elongation of its material must be sufficient to allow the shaping described above, but it must also, under the effect of the pressure of the fluid and at the location of the raised portions of the extraction device, break in the form of small tears without its elongation being too great.

The following description is made with reference to the accompanying drawings, given by way of non-limiting example.

DETAILED DESCRIPTION OF THE DRAWINGS

Figure 1:
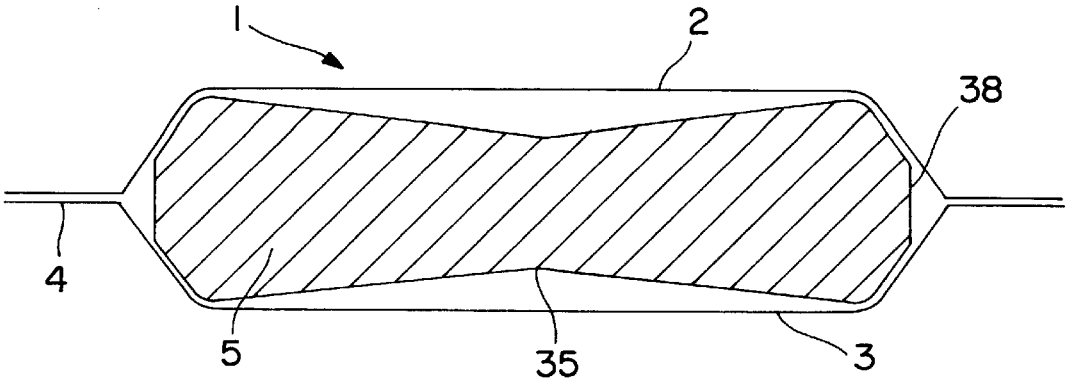
FIG. 1 illustrates a first embodiment of a sachet of the invention.

The sachet 1 of circular shape comprises two sheets of flexible material 2 and 3 which are sealed over their periphery 4 by thermosealing and which contain one piece of cake of compacted ground roast coffee 5 for the preparation of a beverage. The compacted coffee has concave surfaces 35, the general shape of its section being a flattened octagon, whereas that of the sachet is hexagonal. The cylindrical edge 38 of the cake is designed to prevent the undesirable presence of grains in the sealing zone. In terms of figures, the sachet has a total space between the two sheets of 15 $cm^3$, the volume of the compacted coffee is 14 $cm^3$ and has a compacting rate of 30%.

Figure 2:
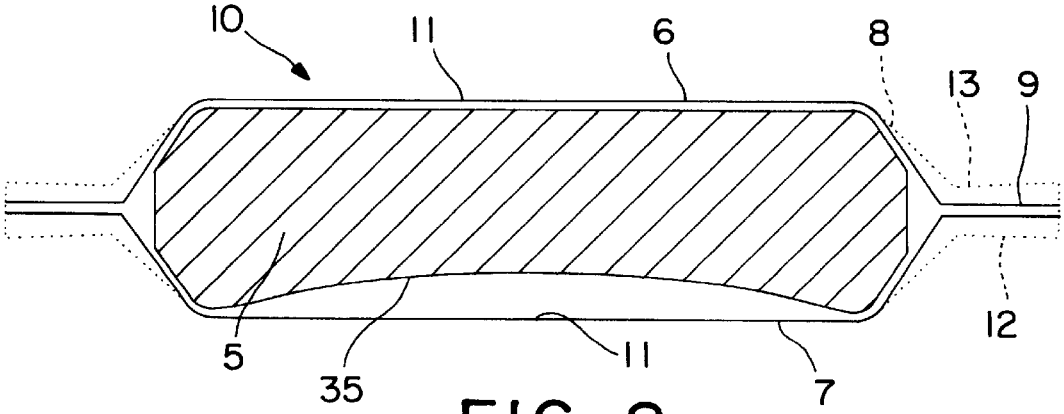
FIG. 2 illustrates a sachet according to a second embodiment.

The sachet 10 of FIG. 2, obtained from two molded sheets 6, 7, has corrugations 8, 12 and 13 whose amplitude and distance from one another increase from the plane surface 11 towards the sealing edge 9. In this example, the cake of coffee has a single concave surface 35 and is not exactly symmetrical, but this difference is not connected with the shape of the sachet.

Figure 3:
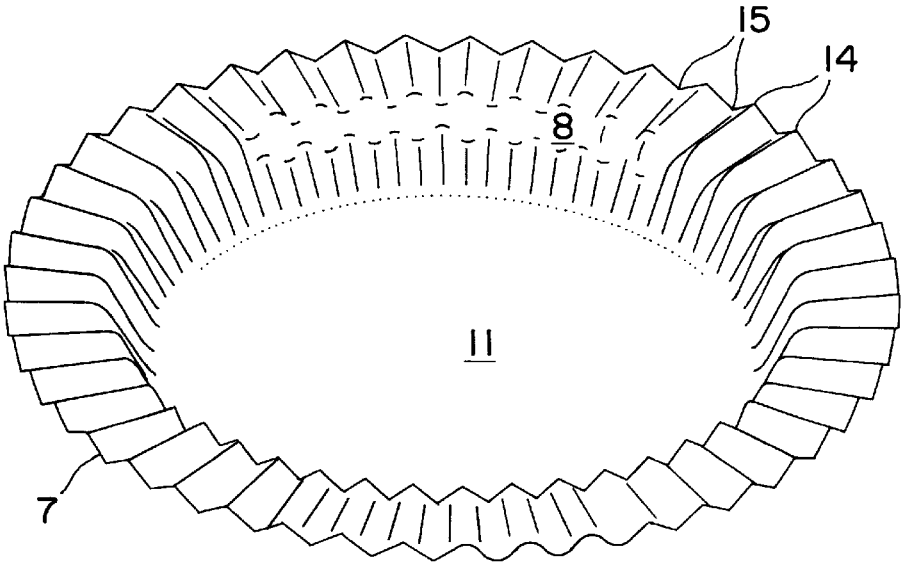
FIG. 3 is a perspective view of a molded sheet used for the sachet of FIG. 2.

FIG. 3 shows a molded sheet 7 with a flat base 11 and corrugations which become increasingly accentuated as the outer edge is approached. These corrugations have bosses 14 and hollows 15.

After placing the ground roast coffee on the base 11, the sheet 6 is positioned so that the bosses of 6 face the hollows of 7 and vice versa. Thermosealing may then be carried out.

Figure 4:
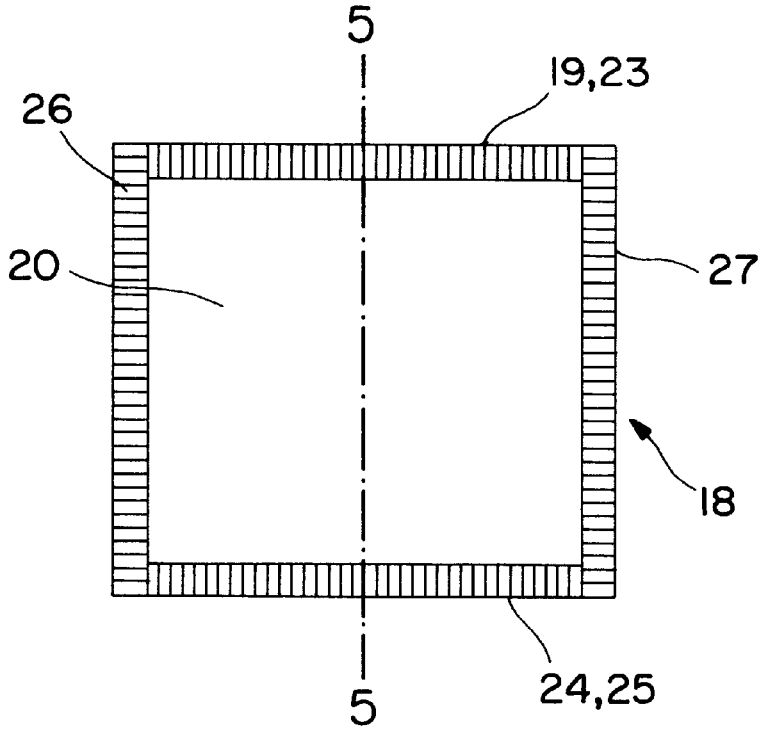
FIG. 4 is a plan view of a sachet according to a third embodiment.
Figure 5:
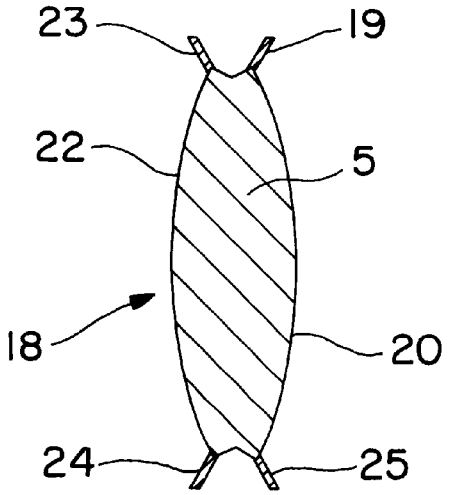
FIG. 5 is a diagrammatic representation in section along the line 5—5 of FIG. 4.

In FIGS. 4 and 5, the sachet 18 is of square shape with two gussets on the opposite sides. The two sheets 20 and 22 are sealed along the two gussets at 19, 23, 24, 25 and on the edges 26, 27 where the two sheets are simply joined. The gussets make it possible to provide the sachet with a specific volume without the appearance of random folds.

Figure 6:
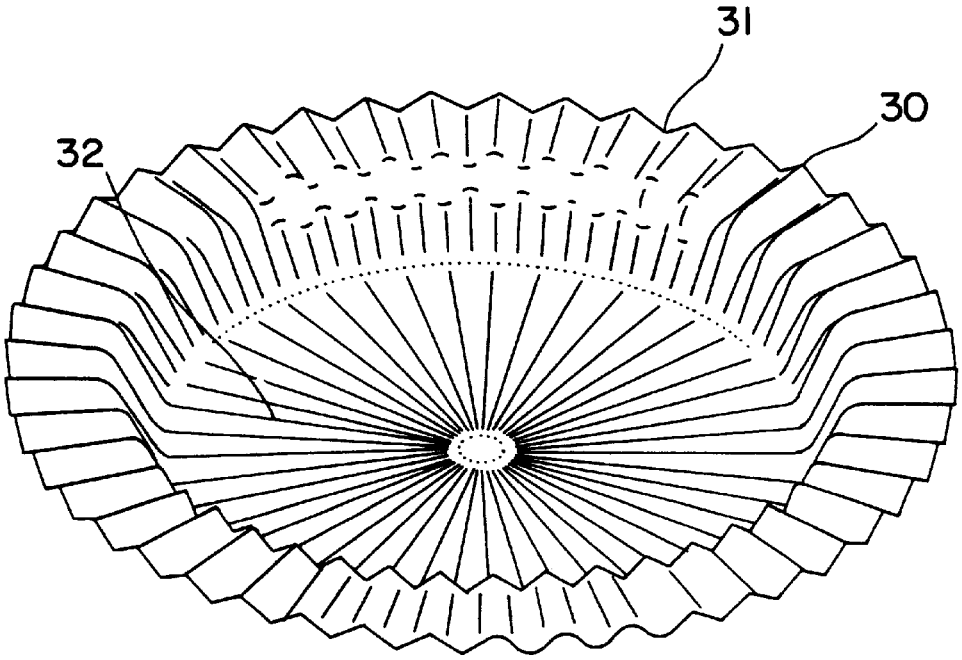
FIG. 6 is a perspective view of a sheet of the sachet according to a fourth embodiment.

FIG. 6 shows a sheet 30 having corrugations 31 on the edge and also on the base 32. Manufacture takes place in the same way as for the sachet on FIG. 2.

Figure 7:
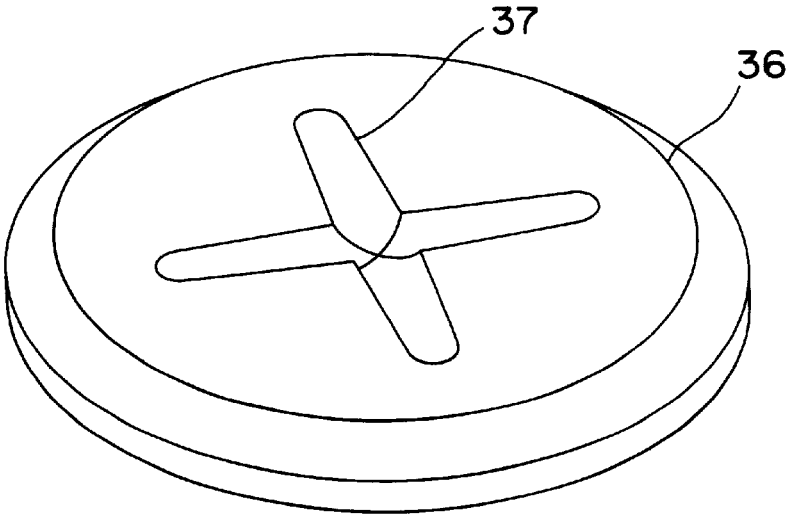
FIG. 7 is a perspective view of a unpackaged compacted coffee.

FIG. 7 shows the compacted substance 36 alone. On at least one surface it has zones 37 for water circulation in the form of channels.

We claim:

1. In a process for preparation of a beverage wherein an extraction fluid is introduced into a sachet which contains a substance which is suitable for preparation of a beverage for obtaining a beverage, the improvements comprising:

positioning a sachet which contains a compacted powder substance cake comprising roast and ground coffee for preparation of a beverage adjacent a surface of a device for extracting a substance under pressure, wherein the cake comprises two cake surfaces which extend to a peripheral cake edge and wherein the sachet comprises two sheets impermeable to oxygen and water vapor, so that one of the two sheets is adjacent the extraction device surface, and wherein the two sheets each comprise three material layers so that, with reference to the cake, the sealed sheets comprise inner, intermediate and outer sachet material layers wherein the inner sachet sheet material layer is a plastic material, the intermediate sheet material layer is aluminum and the outer sheet material layer is a plastic material, and wherein the extraction device surface comprises portions so that upon extraction of the substance under pressure, first, the sheet adjacent the extraction device surface deforms and so that, subsequently, local breakages form in the deformed sheet for providing sheet openings for flow of beverage through the sheet openings and wherein upon the positioning, the cake is positioned between the two sheets and the two sheets extend to peripheral sheet edges which extend beyond the peripheral cake edge and are sealed together to form a sealed edge which circumscribes the sheets so that the cake is enclosed between the sheets and so that the two sheets circumscribed by the sealed edge are substantially symmetrical so that the sealed edge defines a plane through the sachet and wherein the cake and sachet are configured so that the cake has a volume so that there is free space between the cake and at least one sheet and so that the free space is in an amount of less than 20% of a sachet internal volume between the sheet portions circumscribed by the sealed edge and then, after positioning, perforating one sachet sheet with at least one perforating member to provide at least one opening for introducing an extraction fluid into the sachet to the cake substance for extracting the substance under pressure for preparing the beverage;

injecting an extraction fluid under pressure into the perforated sachet and to the cake substance via the at least one opening so that the cake substance is extracted under pressure for preparing the beverage and so that first, the one sheet positioned against the extraction device surface deforms and so that subsequently, localized breakages form in the deformed sheet to provide sheet openings for beverage flow from the sachet; and obtaining the beverage flow from the sachet.

2. In a process for preparation of a beverage wherein an extraction fluid is introduced into a sachet which contains a substance which is suitable for preparation of a beverage for obtaining a beverage, the improvements comprising:

positioning a sachet which contains a compacted powder substance cake comprising roast and ground coffee for preparation of a beverage adjacent a surface of a device for extracting a substance under pressure, wherein the cake comprises two cake surfaces which extend to a peripheral cake edge and wherein the two cake surfaces have a convex shape and wherein the sachet comprises two sheets impermeable to oxygen and water vapor, so that one of the two sheets is adjacent the extraction device surface, and wherein the two sheets each comprise three material layers so that, with reference to the cake, the sealed sheets comprise inner, intermediate and outer sachet material layers wherein the inner sachet sheet material layer is a plastic material, the intermediate sheet material layer is aluminum and the outer sheet material layer is a plastic material, and wherein the extraction device surface comprises portions so that upon extraction of the substance under pressure, first, the sheet adjacent the extraction device surface deforms and so that, subsequently, local breakages form in the deformed sheet for providing sheet openings for flow of beverage through the sheet openings and wherein upon the positioning, the cake is positioned between the two sheets and the two sheets extend to peripheral sheet edges which extend beyond the peripheral cake edge and are sealed together to form a sealed edge which circumscribes the sheets so that the cake is enclosed between the sheets and so that the two sheets circumscribed by the sealed edge are substantially symmetrical so that the sealed edge defines a plane through the sachet and wherein the cake and sachet are configured so that the cake has a volume so that there is free space between the cake and at least one sheet and so that the free space is in an amount of less than 20% of a sachet internal volume between the sheet portions circumscribed by the sealed edge, and then, perforating one sachet sheet with at least one perforating member to provide at least one opening for introducing an extraction fluid into the sachet to the cake for extracting the cake substance under pressure for preparing the beverage;

injecting an extraction fluid under pressure into the perforated sachet and to the cake substance via the at least one opening so that the cake substance is extracted under pressure for preparing the beverage and so that first, the one sheet positioned against the extraction device surface deforms and so that subsequently, localized breakages form in the deformed sheet to provide sheet openings for beverage flow from the sachet; and obtaining the beverage flow from the sachet.

3. A process according to claim 1 wherein at the time of commencing the perforating, one cake surface defines channel impressions therein and the sheet positioned adjacent the one impression surface is perforated.

4. A process according to claim 3 wherein at the time of commencing the perforating, there are a plurality of channel impressions which form channels which extend longitudinally and intersect.

5. A process according to claim 1 or 2 wherein the inner layer plastic material is oriented polypropylene and the outer layer is polyester.

6. A process according to claim 1 or 2 wherein the free space is in an amount of between 1% and 20% of the sachet internal volume.

7. A process according to claim 1 or 2 wherein the free space is at a position between the peripheral cake edge and the sheets.

8. A process according to claim 1 or 2 wherein at the time of commencing the perforating, the sachet has no openings and wherein one sheet is perforated to provide one opening to obtain the perforated sachet.

9. A process according to claim 1 or 2 wherein at the time of commencing the perforating, the sachet has no openings and wherein one sheet is perforated with one member to provide one opening to obtain the perforated sachet.

10. A process according to claim 1 or 2 wherein the roast and ground coffee is in an amount of between 5 g and 20 g.

* * * * *